US005170012A

United States Patent [19]

Braconier

[11] Patent Number: 5,170,012

[45] Date of Patent: Dec. 8, 1992

[54] HINGED MULTI-FUNCTION GASKET

[75] Inventor: Karl Braconier, East Hebron, N.H.

[73] Assignee: Freudenberg-NOK General Partnership, Plymouth, Mich.

[21] Appl. No.: 693,805

[22] Filed: Apr. 30, 1991

[51] Int. Cl.[5] ..... B65D 53/00

[52] U.S. Cl. ..... 174/52.3; 277/235 R; 361/395; 361/412

[58] Field of Search ..... 174/35 GC, 52.3; 277/235 R, 235 B, 237 R, 901; 361/395, 412

[56] References Cited

U.S. PATENT DOCUMENTS 3,191,950 6/1965 Hiltner ..... 277/235 R 3,541,396 1/1969 Cardwell et al. ..... 361/42

*Primary Examiner*—Leo P. Picard

*Assistant Examiner*—David Tone

*Attorney, Agent, or Firm*—Dinnin & Dunn

[57] ABSTRACT

The present invention is a multi-function gasket adapted to support a plurality of components within a support unit having first and second support members. The multi-function gasket includes a frame portion adapted to be disposed between the first and second support members. The multi-function gasket also includes a support portion adapted to be disposed between first and second components to support the first component against the first support member and the second component against the second support member. The multi-function gasket further includes a web portion interconnecting the frame portion and the support portion to allow the frame portion and the support portion to rotate relative to each other, whereby either one of the first and second components may be removed and the support portion rotated to allow access to the other component.

20 Claims, 3 Drawing Sheets

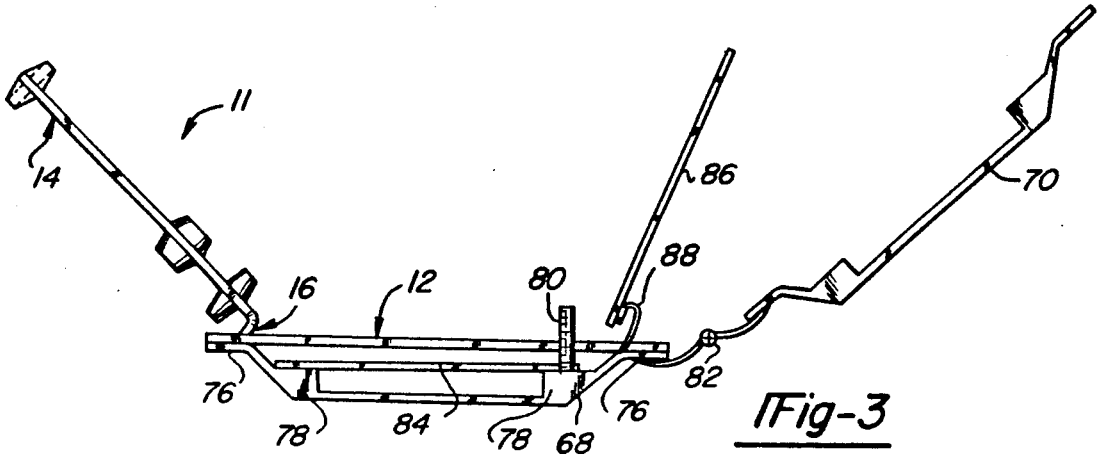
Fig-3
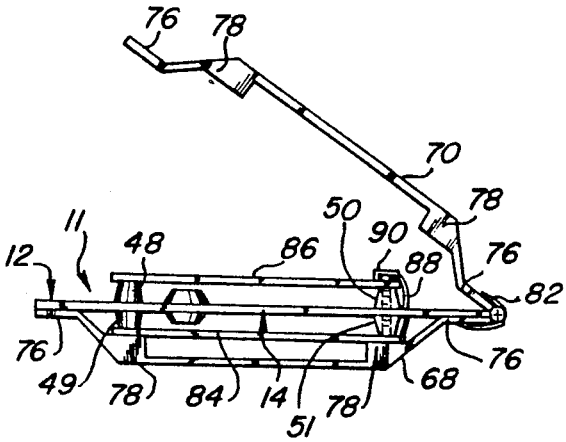
Fig-4
Fig-5
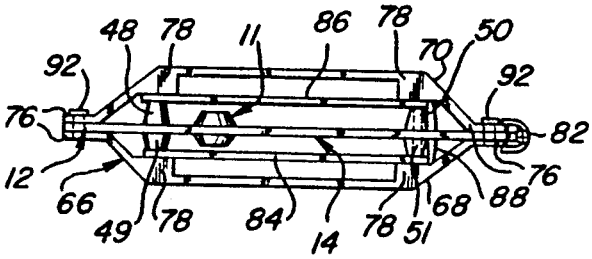

HINGED MULTI-FUNCTION GASKET

BACKGROUND OF THE INVENTION

1. Field of the Invention

The present invention relates generally to gaskets, and more particularly to, a hinged multi-function gasket adapted to support components within a housing or support structure.

2. Description of Related Art

Components such as circuit boards are commonly mounted in a housing or support structure. The support structure may have a plurality of socket members each of which are adapted to receive a single circuit board. The socket members are located in rows and columns within the support structure.

Another support structure for mounting circuit boards provides a resilient clamp to secure a plurality of circuit boards between two supporting structures. An example of such a support structure is shown in U.S. Pat. No. 3,541,396 to Cardwell et al. This patented support structure includes channel forming support members adapted to surround circuit boards. Openings are provided within the support members to facilitate air cooling and a cable connector positively secures a connecting cable to the support members.

One disadvantage of the above support structures is that no cushioning of the circuit boards is provided. Another disadvantage of the above support structures is that neither structure is desired for the engine compartment of an automotive vehicle. Yet another disadvantage of the above support structures is the high cost of materials and assembly time.

SUMMARY OF THE INVENTION

It is, therefore, one object of the present invention to support a plurality of components within a support structure or unit.

It is another object of the present invention to provide a multi-function gasket to support a plurality of circuit boards in stacked relative to one another within a support unit.

It is yet another object of the present invention to provide a support unit for mounting circuit boards in an engine compartment of an automotive vehicle.

It is a further object of the present invention to provide a support unit which is less expensive to make and assemble.

It is still a further object of the present invention to provide a multi-function gasket which cushions circuit boards when mounted in a support unit.

It is yet still a further object of the present invention to provide a multi-function gasket which forces circuit boards against a support unit to allow heat transfer between the circuit boards and support unit.

To achieve the foregoing objects, the present invention is a multi-function gasket adapted to support a plurality of components within a support unit having first and second support members. The multi-function gasket includes a frame portion adapted to be disposed between first and second support members of the support unit. The multi-function gasket also includes a support portion adapted to be disposed between first and second components. The support portion is adapted to support the first component against the first support member and the second component against the second support member. The multi-function gasket further includes a web portion interconnecting the frame portion and the support portion to allow the frame portion and the support portion to rotate relative to each other, whereby either one of the first and second components may be removed and the support portion rotated to allow access to the other component.

One advantage of the present invention is that the multi-function gasket supports a pair of components such as circuit boards in stacked relation to one another within a housing or support unit. Another advantage of the present invention is that the circuit boards are cushioned by the multi-function gasket in a support unit within an engine compartment of an automotive vehicle. Yet another advantage of the present invention is that the multi-function gasket provides a controlled force on the circuit boards to hold them against the support unit to act as a heat sink for heat transfer between the circuit boards and support unit. A further advantage of the present invention is that the multi-function gasket utilizes a typically wasted center portion of conventional gaskets to perform multiple functions of other separate pieces and provides them all as one unit, thereby simplifying assembly and significantly reducing cost of materials and assembly time.

Other objects, features and advantages of the present invention will be readily appreciated as the same becomes better understood after reading the following description in light of the accompanying drawings.

BRIEF DESCRIPTION OF THE DRAWINGS

FIG. 3 is a view similar to FIG. 2 illustrating partial assembly of the support unit and hinged multi-function gasket of FIG. 2.

FIG. 4 is a view similar to FIG. 3 illustrating final assembly of the support unit and hinged multi-function gasket of FIG. 2.

FIG. 5 is a view similar to FIG. 4 illustrating the support unit and hinged multi-function gasket as assembled.

DESCRIPTION OF THE PREFERRED EMBODIMENT(S)

Figure 1:
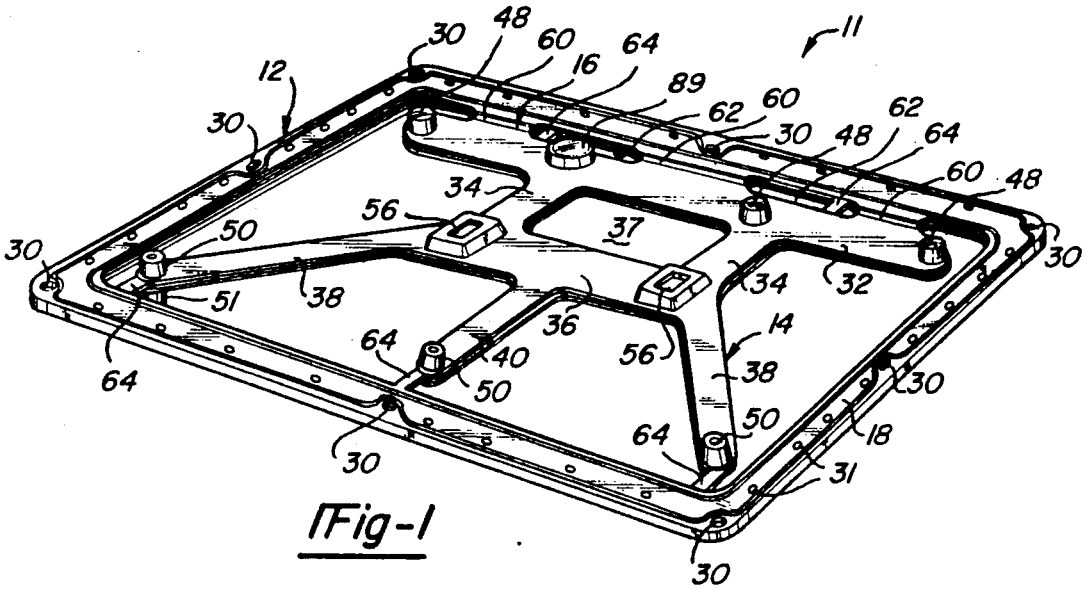
FIG. 1 is a perspective view of a hinged multi-function gasket according to the present invention.
Figure 6:
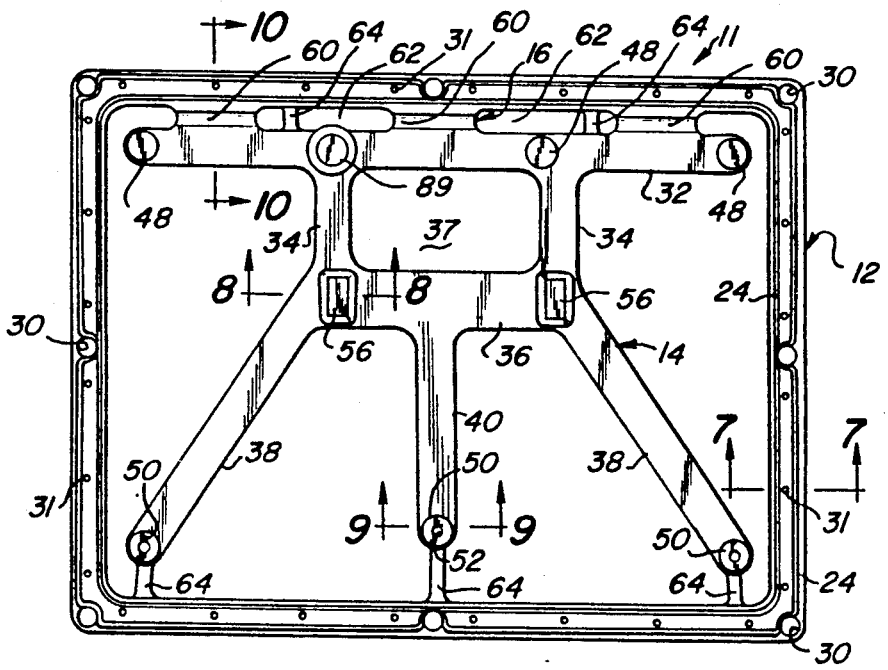
FIG. 6 is a plan view of the hinged multi-function gasket of FIG. 1.
Figure 7:
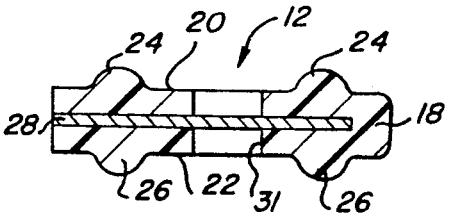
FIG. 7 is a sectional view taken along line 7—7 of FIG. 6.
Figure 10:
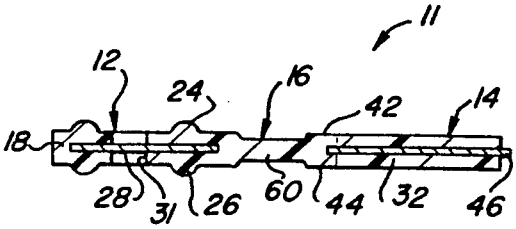
FIG. 10 is a sectional view taken along line 10—10 of FIG. 6.

Referring to FIGS. 1, 6 and 10, a hinged multi-function gasket 11 according to the present invention is shown. The hinged multi-function gasket 11 includes a frame portion, generally indicated at 12, a support portion, generally indicated at 14, and a web portion, generally indicated at 16.

Referring to FIGS. 1, 6, 7 and 10, the frame portion 12 is generally rectangular in shape. The frame portion 12 has a generally rectangular body 18 having an upper and lower outer surface 20 and 22. The frame portion 12 also has at least one, preferably a pair of seal ridges or beads 24 and 26 spaced transversely and extending outwardly from the upper and lower outer surface 20 and 22, respectively. The seal beads 24 and 26 are generally arcuate in cross-section and are integral with the body 18. The body 18 and seal beads 24 and 26 are made of an elastomeric material. The frame portion 12 also includes an insert 28 disposed therein. The insert 28 is generally planar and made of a metal material such as steel. It should be appreciated that the insert 28 may be made of any suitable material such as plastic to provide a desired stiffness to the frame portion 12.

The frame portion 12 also includes a plurality of fastener openings 30 extending therethrough. The fastener openings 30 are located at each corner and midway along each side of the frame portion 12. The frame portion 12 further includes a plurality of pin openings 31 extending only through the elastomeric material. The pin openings 31 are spaced about the frame portion 12. The pin openings 31 are disposed between and spaced from the seal beads 24 and 26, which are continuous about the frame portion 12. The pin openings 31 are formed by pins (not shown) which hold the insert 28 in a mold cavity (not shown) in a predetermined position during molding of the body 18. It should be appreciated that the pin openings 31 are non-functional once formed. It should also be appreciated that the pin openings 31 may be optional.

Referring to FIGS. 1, 6, 8, 9 and 10, the support portion 14 is disposed within the frame portion 12. The support portion 14 includes a bar member 32 extending longitudinally and pivotally connected by the web portion 16 to one side of the frame portion 12. The support portion 14 also includes a pair of side members 34 extending from the bar member 32 toward an opposed side of the frame portion 12. The support portion 14 further includes a center member 36 extending longitudinally and connected to the ends of the side members 34. The bar member 32, side members 34 and center member 36 form a generally rectangular opening 37. The support portion 14 includes a plurality of first and second arm members 38 and 40 extending outwardly from the center member 36 toward the opposed side of the frame portion 12. In the preferred embodiment, there are two (2) first arm members 38 and one (1) second arm member 40. The first arm members 38 extend outwardly at an angle from the center member 36 toward each corner of the opposed side of the frame portion 12, but terminating a distance therefrom. The second arm member 40 extends outwardly perpendicularly from the center member 36 toward the opposed side of the frame portion 12, but terminating a distance therefrom. The second arm member 40 is disposed between and longitudinally spaced from the first arm members 38.

Preferably, the bar member 32, side members 34, center member 36 and first and second arm members 38 and 40 are integral and have a planar top and bottom outer surface 42 and 44. The support portion 14 is preferably made of an elastomeric material and includes an insert 46 disposed therein. The insert 46 extends through the bar member 32, side members 34, center member 36 and first and second arm members 38 and 40 and is integral throughout. The insert 46 is made of a metal material such as steel. It should be appreciated that the insert 46 may be made of any suitable material such as plastic to provide a desired stiffness to the support portion 14.

The support portion 14 includes at least one, preferably a plurality of support cushions 48 and 49 and post members 50 and 51, respectively. The support cushions 48 and 49 are generally frustoconical in shape and extend outwardly from the top and bottom outer surface 42 and 44, respectively. In the preferred embodiment, three (3) support cushions 48 and 49 are located and spaced longitudinally along the bar member 32.

The post members 50 and 51 are generally frustoconical in shape and extend outwardly from the top and bottom outer surface 42 and 44, respectively. In the preferred embodiment, three (3) post members 50 and 51 are provided with one each being located at the free end of the first and second arm members 38 and 40. The post members 50 and 51 have an aperture 52 extending therethrough. The insert 46 may extend partially into the post members 50 and 51. The aperture 52 may have an enlarged counter-sink portion 54 at each end.

Figure 8:
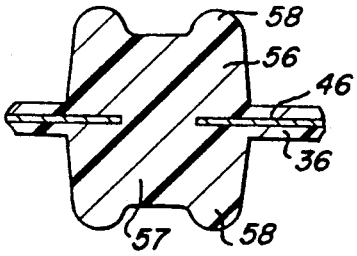
FIG. 8 is a sectional view taken along line 8—8 of FIG. 6.
Figure 9:
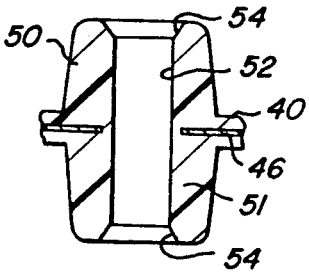
FIG. 9 is a sectional view taken along line 9—9 of FIG. 6.

Referring to FIGS. 6 and 8, the support portion 14 may include a plurality of block members 56 and 57. The block members 56 and 57 are generally rectangular in shape and extend outwardly from the top and bottom outer surface 42 and 44, respectively. In the preferred embodiment, two (2) block members 56 and 57 are located and spaced longitudinally along the center member 36. The block members 56 and 57 are made of an elastomeric material and the insert 46 may extend partially into the block members 56 and 57. The block members 56 and 57 also have a compression bead 58 extending around the upper outer periphery thereof. The compression bead 58 is generally arcuate in cross-section and integral with the block members 56 and 57. The compression bead 58 is compressed to control the force on internal components such as circuit boards 84 and 86. It should be appreciated that the block members 56 and 57 hold the circuit boards 84 and 86 (FIG. 2) against a support unit 66 (FIG. 2) and allow heat transfer between the circuit boards 84 and 86 and the support unit 66. It should also be appreciated that the block members 56 and 57 are optional.

Referring to FIGS. 1, 6 and 10, the web portion 16 interconnects the frame portion 12 and support portion 14. The web portion 16 includes a plurality of web members 60. The web members 60 are generally rectangular in shape and interconnect the bar member 32 and body 18 along one side of the frame portion 12. In the preferred embodiment, three (3) web members 60 are spaced longitudinally to form a space 62 therebetween. The web members 60 are made of an elastomeric material and have a thickness less than a thickness of frame portion 12 and support portion 14.

The hinged multi-function gasket also includes at least one, preferably a plurality of frangible portions 64. The frangible portions 64 interconnect the free end of the first and second arm members 38 and 40 and the adjacent side of the frame portion 12. The frangible portions 64 also interconnect the bar member 32 and the adjacent side of the frame portion 12 across the space 62. The frangible portions 64 are made of the same rigid material as the inserts 46 and 26 such as a metal material and interconnects insert 46 and insert 28. The frangible portions 64 are adapted to be cut or removed to allow the support portion 14 to rotate relative to the frame portion 12. It should be appreciated that the frangible portions 64 may be optionally covered with elastomeric material.

During fabrication, the insert 28 and insert 46 extend through the frangible portions 64 and are formed as an integral one-piece member by conventional stamping processes. The formed stamping is then inserted into a mold and elastomeric material is molded onto the formed stamping by conventional injection molding processes to form the elastomeric portions of the hinged multi-function gasket 11. Prior to assembly, the frangible portions 64 are cut or removed, allowing the web portion 16 to flex and, in turn, allowing the support portion 14 to rotate relative to the frame portion 12.

Figure 2:
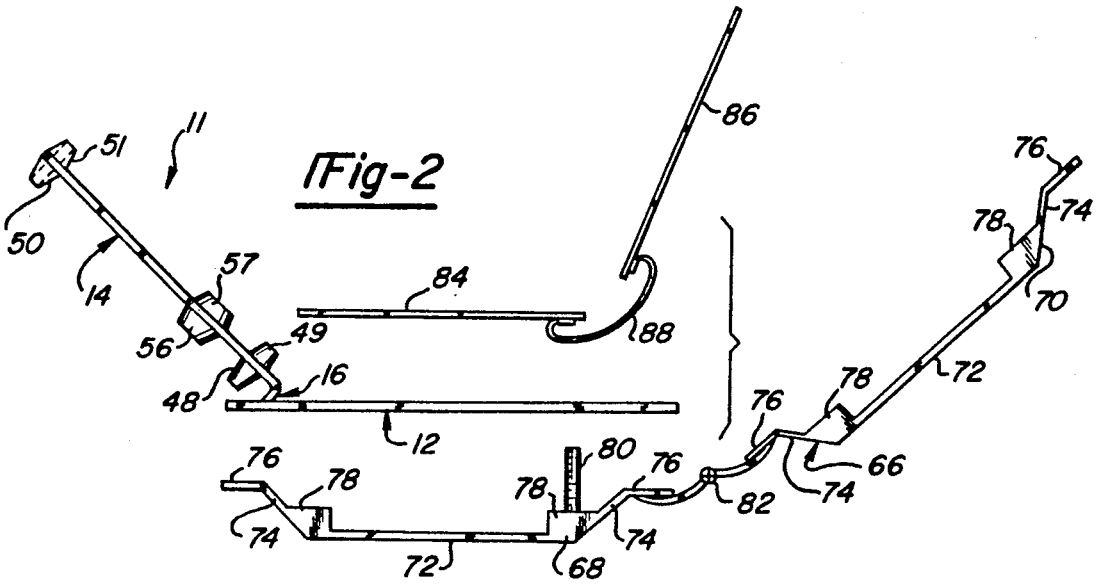
FIG. 2 is an exploded view of a support unit for the hinged multi-function gasket of FIG. 1.

Referring to FIG. 2, a housing or support structure or unit, generally indicated at 66, is adapted to support a plurality of components typically within an engine compartment (not shown) of an automotive vehicle (now shown). The support unit 66 includes first and second support members 68 and 70. The first and second support members 68 and 70 are generally rectangular in shape with a generally conical cross-sectional shape. The first and second support members 68 and 70 are preferably made of a metal material such as aluminum. It should be appreciated that any suitable material may be used.

Each support member 68 and 70 has a center section 72 which is generally planar with side sections 74 extending outwardly at an angle from the center section 72. The first and second support members 68 and 70 have a flange section 76 extending outwardly from the end of the side sections 74. The flange sections 76 are generally planar and substantially parallel to the center section 72. Each support member 68 and 70 includes raised portions 78 extending outwardly from the junction of the center section 72 and side sections 74. The raised portions 78 are generally rectangular in cross-section. One of the raised portions 78 of the first support member 68 includes a plurality of posts 80. The posts 80 are generally cylindrical in shape and have a diameter less than a diameter of the aperture 52 of the post members 50. In the preferred embodiment, three (3) posts 80 are located and spaced longitudinally along the raised portion 78 of the first support member 68.

The support unit 66 also includes a hinge 82 secured to one side of adjacent flange sections 76 of the first and second support members 68 and 70. The hinge 82 allows the first and second support members 68 and 70 to rotate relative to each other. The support unit 66 further includes a plurality of components such as first and second circuit boards 84 and 86 and a connector 88 interconnecting the first and second circuit boards 84 and 86. The connector 88 is a ribbon wire which electrically interconnects the first and second circuit boards 84 and 86. The support portion 14 may include a hollow cylindrical section 89 of elastomer material which can accommodate a wire mesh (not shown) that serves as a common connection for anti-static purposes between the circuit boards 84 and 86.

Referring to FIGS. 3 through 5, in operation, the frame portion 12 of the hinged multi-function gasket 11 is disposed upon the flange sections 76 of the first support member 68. The support portion 14 of the hinged multi-function gasket 11 is rotated upwardly and outwardly. The first circuit board 84 is disposed upon the raised portions 78 of the first support member 68. The support portion 14 is then rotated downwardly and inwardly toward the first support member 68 such that the posts 80 extend through the apertures 52 of the post members 50 and 51. The support cushions 49 and post members 51 of the support portion 14 rest upon the first circuit board 84. The second circuit board 86 is then rotated to rest upon the upper surface of the support cushions 48 and post members 50. The second circuit board 86 may include fasteners 90 which are adapted to engage the end of the posts 80 to secure the second circuit board 86 thereto.

Next, the second support member 70 is rotated such that the flange sections 76 are disposed upon the frame portion 12 of the hinged multi-function gasket 11 and the raised portions 78 are disposed upon the second circuit board 86. The support unit 66 includes a plurality of fasteners 92 such as screws which extend through apertures (not shown) in the flange sections 76 and fastener openings 30 of the hinged multi-function gasket 11 to secure the first and second support members 68 and 70 together. When assembled, the hinged multi-function gasket 11 is disposed or sandwiched between the first and second support members 68 and 70 and the support cushions 48 and post members 50 support the second circuit board 86 against the raised portions 76 of the second support member 70 and the support cushions 49 and post members 51 support the first circuit board against the raised portions 78 of the first support member 68. It should be appreciated that the support cushions 48 and 49 and post members 50 and 51 may flex to act as cushions to cushion the first and second circuit boards 84 and 86. It should also be appreciated that the support members 68 and 70 are closed at each end to form a sealed unit.

Accordingly, the hinged multi-function gasket 11 has a frame portion 12 which performs the function of sealing the support unit 66. The hinged multi-function gasket 11 also has a support portion 14 which functions to hold the internal components, such as circuit boards, in place and in stacked relation to one another. The hinged multi-function gasket 11 further has a web portion 16 which allows the support portion 14 to rotate to provide access to one circuit board when the other is removed without removing the gasket. Thus, the hinged multi-function gasket 11 performs multiple functions and provides them all as one unit, thereby simplifying assembly and reducing cost.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A multi-function gasket adapted to support a plurality of components within a support unit having first and second support members, comprising:

a frame portion adapted to be disposed between first and second support members of a support unit;

a support portion adapted to be disposed between first and second components, said support portion adapted to support the first component against the first support member and the second component against the second support member; and a web portion interconnecting said frame portion and said support portion to allow said frame portion and said support portion to rotate relative to each other, whereby either one of the first and second components may be removed and the support portion rotated to allow access to the other component.

2. A multi-function gasket as set forth in claim 1 wherein said frame portion includes first and second outer surfaces.

3. A multi-function gasket as set forth in claim 2 wherein said frame portion includes at least one seal bead extending outwardly from said first and second outer surfaces.

4. A multi-function gasket as set forth in claim 3 wherein said at least one seal bead is circumscribingly continuous about said frame portion.

5. A multi-function gasket as set forth in claim 2 wherein said frame portion includes a pair of seal beads spaced transversely and extending about said frame portion.

6. A multi-function gasket as set forth in claim 1 including an insert disposed within said frame portion.

7. A multi-function gasket as set forth in claim 1 wherein said support portion includes a bar member extending longitudinally, at least one side member extending from said bar member, a center member connected to said at least one side member, and at least one arm member extending outwardly from said center member.

8. A multi-function gasket as set forth in claim 7 wherein said support portion has upper and lower outer surfaces.

9. A multi-function gasket as set forth in claim 8 wherein said support portion includes at least one support cushion extending outwardly from said upper and lower outer surfaces.

10. A multi-function gasket as set forth in claim 9 wherein said at least one arm member includes at least one post member extending outwardly from said upper and lower outer surfaces.

11. A multi-function gasket as set forth in claim 10 wherein said at least one post member includes means forming an aperture extending therethrough.

12. A multi-function gasket as set forth in claim 11 including an insert disposed within said support portion.

13. A multi-function gasket as set forth in claim 1 wherein said web portion is made of an elastomeric material.

14. A multi-function gasket as set forth in claim 13 wherein said web portion includes a plurality of web members spaced longitudinally.

15. A multi-function gasket as set forth in claim 1 including a plurality of frangible portions interconnecting said support portion and said frame portion.

16. A hinged multi-function gasket adapted to support a plurality of circuit boards in stacked relation to one another within a support unit having first and second support members, comprising:

a frame portion adapted to be disposed between first and second support members of a support unit;

a support portion adapted to be disposed between first and second circuit boards in stacked relation to one another, said support portion adapted to support the first circuit board against the first support member and the second circuit board against the second support member;

a web portion interconnecting said frame portion and said support portion to allow said frame portion and said support portion to rotate relative to each other, whereby either one of the first and second circuit boards may be removed and the support portion rotated to allow access to the other circuit board;

said frame portion including first and second outer surfaces and at least one seal bead extending outwardly from said first and second surfaces;

said support portion has first and second outer surfaces and at least one cushioning member extending outwardly from said first and second outer surfaces; and a plurality of frangible portions interconnecting said support portion and said frame portion.

17. A support unit, comprising:

first and second support members each having opposed first and second flange sections;

a hinge attached to said first flange section of said first and second support members to allow said first and second support members to rotate relative to each other;

said first and second support members each having at least one raised portion;

first and second circuit boards, said first circuit board being disposed adjacent said raised portion of said first support member and said second circuit board being disposed adjacent said raised portion of said second support member;

means electrically interconnecting said first and second circuit boards;

a hinged multi-function gasket disposed between said first and second circuit boards for supporting said first and second circuit boards against said raised portions of said first and second support members; and fastening means for securing said first and second support members together.

18. A support unit as set forth in claim 17 wherein said hinged multi-function gasket comprises a frame portion adapted to be disposed between said first and second support members, a support portion adapted to be disposed between said first and second circuit boards, and a web portion interconnecting said frame portion and said support portion to allow said frame portion and said support portion to rotate relative to each other.

19. A support unit as set forth in claim 18 wherein said frame portion includes first and second outer surfaces and at least one seal bead extending outwardly from said first and second outer surfaces.

20. A support unit as set forth in claim 18 including a plurality of frangible portions interconnecting said support portion and said frame portion.

* * * * *